US011338948B2

(12) United States Patent
Beesley et al.

(10) Patent No.: US 11,338,948 B2
(45) Date of Patent: May 24, 2022

(54) PROGRESSIVE RATE CASE CUSHION

(71) Applicant: ILLINOIS TOOL WORKS INC., Glenview, IL (US)

(72) Inventors: Robert C. Beesley, Greenville, SC (US); J. Mark Nunn, Simpsonville, SC (US); Benjamin G. Abrams, II, Landrum, SC (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 443 days.

(21) Appl. No.: 16/053,363

(22) Filed: Aug. 2, 2018

(65) Prior Publication Data

US 2019/0039760 A1 Feb. 7, 2019

Related U.S. Application Data

(60) Provisional application No. 62/540,425, filed on Aug. 2, 2017.

(51) Int. Cl.

| | |
|---|---|
| ***B65B 21/16*** | (2006.01) |
| ***B65B 43/54*** | (2006.01) |
| *B65B 5/10* | (2006.01) |

(52) U.S. Cl.

CPC ..... *B65B 21/16* (2013.01); *B65B 43/54* (2013.01); *B65B 5/101* (2013.01)

(58) Field of Classification Search

CPC ..... B65B 21/16; B65B 5/101; B65B 43/54
USPC ..... 53/235
See application file for complete search history.

(56) References Cited

U.S. PATENT DOCUMENTS

| | | | | | |
|---|---|---|---|---|---|
| 3,826,382 | A * | 7/1974 | Zappia | B65B 21/186 | 414/729 |
| 3,869,843 | A * | 3/1975 | Darrah, III | B65B 21/16 | 53/448 |
| 3,894,294 | A * | 7/1975 | Blinow | G03B 19/12 | 396/350 |
| 4,446,672 | A * | 5/1984 | Raudat | B65B 21/16 | 53/246 |
| 4,494,355 | A * | 1/1985 | Johnson | B65B 21/16 | 53/247 |
| 4,558,648 | A * | 12/1985 | Franklin | B66F 7/065 | 108/136 |
| 4,570,413 | A * | 2/1986 | Raudat | B65B 39/006 | 53/247 |
| 4,585,389 | A * | 4/1986 | Watanabe | B21D 43/105 | 198/468.4 |
| 4,611,705 | A * | 9/1986 | Fluck | B65B 23/14 | 198/419.3 |
| 5,061,269 | A * | 10/1991 | Muller | A61B 17/1611 | 606/83 |
| 5,299,906 | A * | 4/1994 | Stone | B65G 1/07 | 187/269 |

(Continued)

*Primary Examiner* — Robert F Long
*Assistant Examiner* — Xavier A Madison
(74) *Attorney, Agent, or Firm* — Pauley Erickson & Swanson

(57) ABSTRACT

A drop packing apparatus for accepting one or more articles into a case, the drop packaging apparatus including a case pad for accommodating the case and a progressive rate linkage connected with respect to the case pad. A shock absorber is connected with respect to the progressive rate linkage. A conveyor 90 or similar device is connected with respect to the drop packing apparatus to provide a stream of articles to the case.

13 Claims, 2 Drawing Sheets

(56) References Cited

U.S. PATENT DOCUMENTS

| | | | | | |
|---|---|---|---|---|---|
| 5,632,209 | A * | 5/1997 | Sakakibara | B66F 7/065 | 108/145 |
| 5,807,210 | A * | 9/1998 | Devlin | A63B 22/0056 | 482/146 |
| 5,833,198 | A * | 11/1998 | Graetz | A47B 9/16 | 248/370 |
| 6,595,899 | B2 * | 7/2003 | Liang | A63B 22/0056 | 482/51 |
| 6,672,430 | B2 * | 1/2004 | Boucher | B66F 7/065 | 108/145 |
| 7,246,784 | B1 * | 7/2007 | Lopez | A47B 51/00 | 108/145 |
| 7,895,814 | B1 * | 3/2011 | Levins, Sr | B65B 21/16 | 53/475 |
| 9,668,572 | B2 * | 6/2017 | Ergun | A47B 21/02 | |
| 2004/0069979 | A1 * | 4/2004 | Hicks | B66F 7/0608 | 254/122 |
| 2006/0021262 | A1 * | 2/2006 | Killion | A43B 13/184 | 36/136 |

* cited by examiner

PROGRESSIVE RATE CASE CUSHION

CROSS-REFERENCE TO RELATED APPLICATIONS

This application claims the benefit of and priority to U.S. Provisional Application, Ser. No. 62/540,425, filed 2 Aug. 2017. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates generally to a drop packer and, more particularly, to an apparatus for absorbing impacts when one or more articles are dropped into a carton.

Description of Prior Art

A "drop packer" is a machine that positions a load of bottles or other articles over an empty box, carton or other container positioned on a case pad, then releases the load allowing it to drop into the box. Drop packers must use some means to absorb the shock of impact to prevent damage to the items being dropped or to the machine itself.

Traditionally, the impact is absorbed by industrial shock absorbers. These industrial shock absorbers are arranged directly in-line with the direction of impact and dampen in compression. Associated problems with such drop packers are numerous.

Firstly, compression damping is hard on the shock absorber. The valving and internal parts of the shock absorber are impacted at high speed and then must decelerate the load of bottles. In high load applications, the life can be quite short. Some drop packers require replacement of the shocks every few months. The oil inside the shock absorber cavities causing damage to the valves and orifices. Some oil is lost to evaporation.

Secondly, the impact on the articles, such as bottles, is high during operation of a conventional drop packer. Damaged products and costly line shutdowns may result from such impacts and/or damage.

Thirdly, there is no provision to keep the case pad level. The shock absorbers are traditionally arranged under the load depending on the size and position of the box. The position of the shock absorbers is always a compromise between the various box sizes. When the shock absorbers are not centered directly under the center of gravity of the box it can rock violently in the drop. This causes damage to the articles, including bottle breakage.

The "industrial" shock absorber that is normally used in this application only functions in compression. The energy from the load dropping onto the shock is dissipated by squeezing oil through an orifice. FIG. 1 shows a typical drop packer having an industrial shock absorber. The flat surface of the case pad permits only compression forces and the small spring only functions to return the piston to the home position. Industrial shocks only have compression damping.

SUMMARY OF THE INVENTION

The present invention is directed to a case packer having a shock absorber with a progressive linkage wherein the shock absorber includes a compression spring and a damper that dissipates stored energy in a spring. An example of such a shock absorber is an automotive or motorcycle shock absorber.

Automotive/motorcycle/mountain bike shock absorbers typically absorb compressive forces through a spring, which converts the kinetic energy to potential energy. Unlike an industrial shock absorber, they have little compression damping. Such automotive shock absorbers use rebound damping to release the energy in the spring at a controlled rate, and this is easier on the internal components of the device.

The "automotive" shock absorbs compressive forces via a spring. The damping function works mainly on the "rebound." Rebound damping limits the vehicle (or apparatus) from bouncing up after absorbing a bump in the road. Connections on the automotive shock allow both compression and tension forces, and the heavy spring meant to absorb energy.

The case packer according to a preferred embodiment thus absorbs energy with a spring and uses rebound damping to prevent the case from bouncing back up. This has several advantages. Firstly, a compression damper uses viscous friction to absorb energy. Viscous friction is a function of speed. This means that the initial impact of the load of bottles will be harsh because they are traveling at high speed. Spring forces are not speed dependent, so when a spring is used to absorb the energy from a load of bottles the initial impact is softer. Secondly, the drop energy, now stored in the spring, is slowly released through the action of rebound damping. This relatively slow release of energy is gentler on the shock absorber than the hammering effect on a compression damper. This means longer life for the components.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
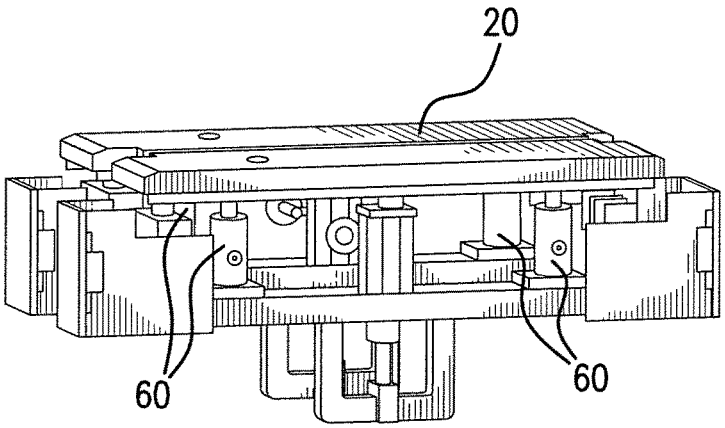
FIG. 1 (PRIOR ART)
FIG. 1 is a perspective side view of a representative prior art apparatus.
Figure 2:
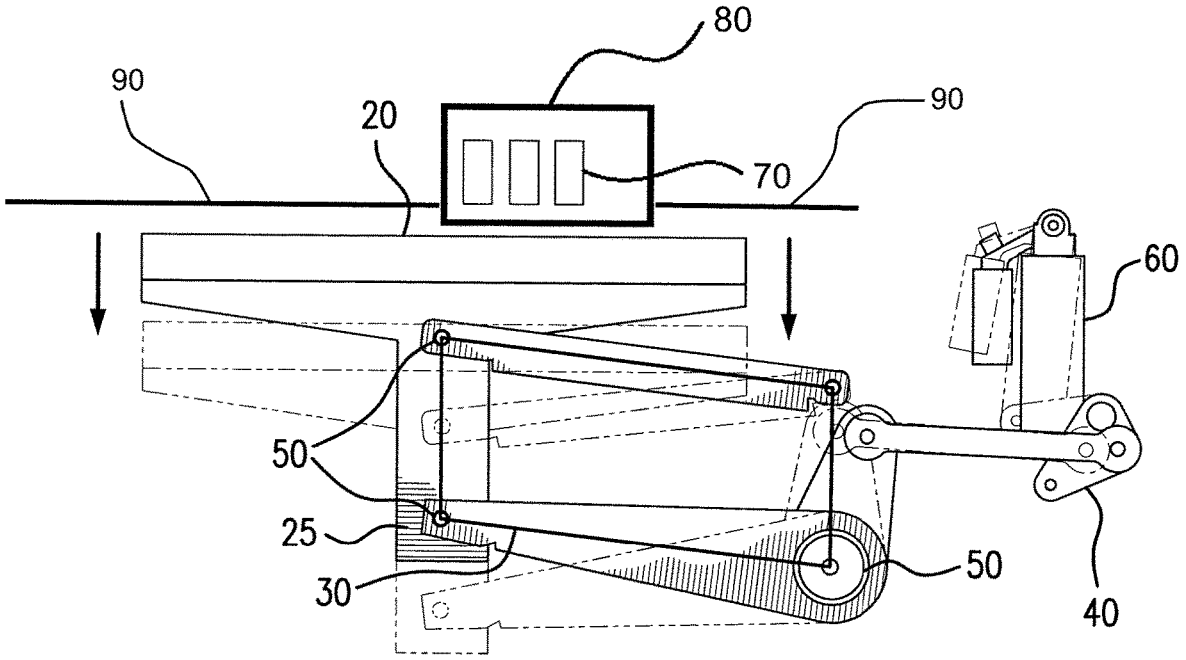
FIG. 2 is a schematic of an apparatus according to one preferred embodiment of the invention.

FIG. 2 shows a schematic of an apparatus according to one preferred embodiment of the invention. A preferred drop packing apparatus, such as the apparatus shown schematically, preferably includes one or more of the following elements: a case pad 20; a four bar linkage 30; a progressive rate linkage 40; one or more flexible bushings 50; and a shock absorber 60.

The present invention is directed to a case packer having a shock absorber 60 with a progressive linkage wherein the shock absorber 60 includes a compression spring and a damper that dissipates stored energy in the spring. An example of such a shock absorber 60 is an automotive or motorcycle shock absorber. The shock absorber 60 as described preferably absorbs compressive forces through the spring, which converts the kinetic energy to potential energy. Unlike an industrial shock absorber, the shock absorber 60 preferred in association with this invention has little compression damping. Such preferred shock absorbers 60 use rebound damping to release the energy in the spring at a controlled rate, and this is easier on the internal components of the device.

The drop packing apparatus for accepting one or more articles 70 into a case 80, as shown in FIG. 2, preferably further includes a case pad 20 for accommodating the case 80. The case pad 20 comprises a generally planar surface of sufficient size to hold the case 80 and is preferably formed of an impact resistant plastic, such as polypropylene. In this way, the case pad 20 is preferably constructed of a lightweight but strong platform made of impact resistant material that maintains a low inertia platform to reduce the initial impact on the articles 70, particularly bottles or similar breakable articles. The case pad 20 may further include a support column 25 to which one or more of the following components are attached.

A four bar linkage 30 is preferably connected with respect to the case pad 20. The four bar linkage 30 preferably consists of four bars or links connected in a loop by four joints. Two or more and preferably four of the joints are hinged or otherwise moveable relative to each other. The four bar linkage 30 preferably maintains the case pad 20 in a level position 13 and the shock absorber 60. As shown in FIG. 2, the case pad 20 preferably includes the support column 25 to which the four bar linkage 30 is connected.

Two or more and preferably four flexible bushings 50 are connected between the bars or links of the four bar linkage 30 and connect a progressive rate linkage 40. Although the joints within the four bar linkage 30 may comprise other moveable arrangements or materials, rubber bushings in the linkage absorb high frequency vibrations thereby limiting damage to parts.

Figure 3:
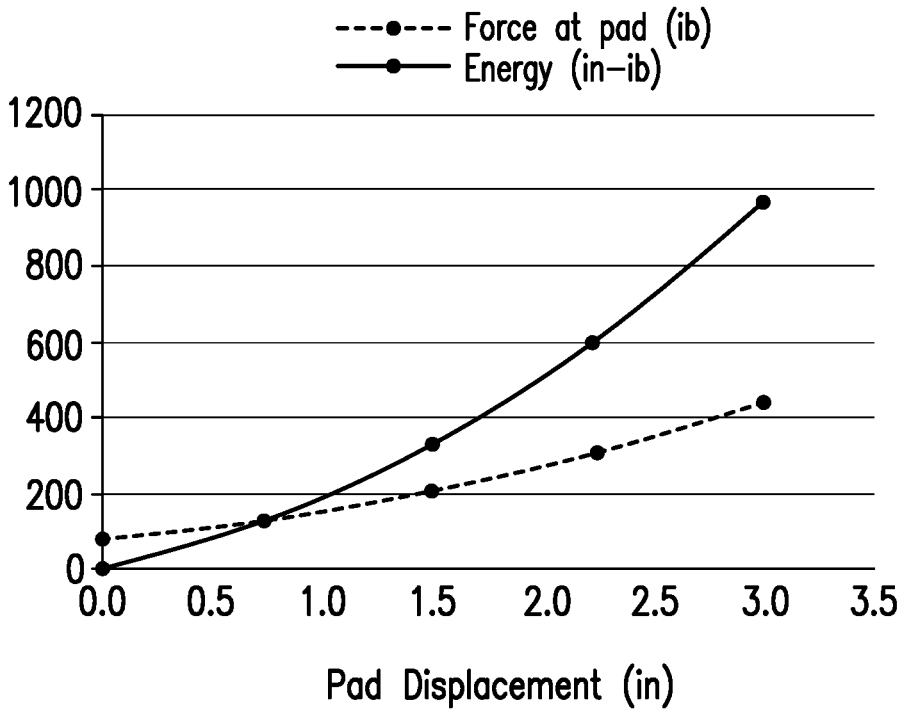
FIG. 3 is a graph of a representative force/displacement curve according to one preferred embodiment of the invention.

The progressive rate linkage 40 is thus positioned between the shock absorber 60 and the four bar linkage 30. A spring by itself without the progressive rate linkage 40 includes a linear relationship between force and displacement. The progressive rate linkage 40 causes the system to have little resistance to deflection at first, then the resistance increases rapidly. This reduces the shock forces on the articles, such as bottles, because it causes them to settle against the bottom of the box on the platform before really slowing them down. FIG. 3 shows a graph of the actual force/displacement curve of the system according to a preferred embodiment of the invention. Without the progressive rate linkage 40, the line shown in FIG. 3 would be straight.

The shock absorber 60 is then connected with respect to the progressive rate linkage 40 and is preferably configured as described above. Specifically, the shock absorber 60 comprises a compression spring and damper that dissipates the stored energy in the spring. As shown in FIG. 2, the shock absorber 60 is preferably arranged out of line of an axis of impact on the case pad 20 and more specifically out of line with the support column 25 of the case pad.

While in the foregoing specification this invention has been described in relation to certain preferred embodiments thereof, and many details have been set forth for purpose of illustration, it will be apparent to those skilled in the art that the subject invention is susceptible to additional embodiments and that certain of the details described herein can be varied considerably without departing from the basic principles of the invention.

The invention claimed is:

1. A drop packing apparatus for accepting one or more articles into a case, the drop packaging apparatus comprising:

a case pad for accommodating the case;

a case pad column connected with respect to the case pad;

a progressive rate linkage connected with respect to the case pad;

a shock absorber connected with respect to the progressive rate linkage;

a four bar linkage connected between the case pad and the progressive rate linkage, wherein the four bar linkage comprises four bars configured into a loop by four joints;

wherein the case pad column is operatively connected to a first side of the four bar linkage; and wherein the progressive rate linkage is operatively connected to a second side of the four bar linkage, spaced apart from the second side of the four bar linkage, wherein the second side of the four bar linkage is opposite the first side of the four bar linkage.

2. The drop packing apparatus of claim 1 further comprising:

a flexible bushing connected between the four bar linkage and the progressive rate linkage.

3. The drop packing apparatus of claim 1 wherein the case pad comprises an impact resistant plastic.

4. The drop packaging apparatus of claim 3 wherein the impact resistant plastic comprises polypropylene.

5. The drop packaging apparatus of claim 1 wherein the shock absorber comprises a compression spring and damper that dissipates the stored energy in the spring.

6. The drop packaging apparatus of claim 5 wherein the shock absorber comprises an automotive shock absorber.

7. The drop packaging apparatus of claim 1 wherein the case pad includes a support column to which the four bar linkage is connected.

8. The drop packaging apparatus of claim 1 wherein the shock absorber is arranged out of line of an axis of impact on the case pad.

9. The drop packing apparatus of claim 1, further comprising a conveyor configured to supply a stream of articles into the case.

10. A drop packing apparatus for accepting one or more articles into a case, the drop packaging apparatus comprising:

a case pad for accommodating the case;

a four bar linkage connected with respect to the case pad, wherein the four bar linkage comprises four bars configured into a loop by four joints;

a progressive rate linkage connected with respect to, and spaced apart from, the four bar linkage;

a flexible bushing connected between the four bar linkage and the progressive rate linkage; and a shock absorber connected with respect to the progressive rate linkage, wherein the shock absorber is arranged in parallel with the four bar linkage.

11. The drop packing apparatus of claim 10 wherein the case pad includes a support column to which the four bar linkage is connected.

12. The drop packing apparatus of claim 10 wherein the shock absorber comprises an automotive shock absorber.

13. The drop packing apparatus of claim 10 wherein the shock absorber is arranged out of line of an axis of impact on the case pad.

* * * * *